US009828873B2

(12) United States Patent
Maeda

(10) Patent No.: US 9,828,873 B2
(45) Date of Patent: Nov. 28, 2017

(54) TURBOCHARGER

(71) Applicant: Osamu Maeda, Toyota (JP)

(72) Inventor: Osamu Maeda, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 389 days.

(21) Appl. No.: 14/646,617

(22) PCT Filed: Nov. 21, 2013

(86) PCT No.: PCT/JP2013/081350

§ 371 (c)(1),
(2) Date: May 21, 2015

(87) PCT Pub. No.: WO2014/103570

PCT Pub. Date: Jul. 3, 2014

(65) Prior Publication Data

US 2015/0300202 A1 Oct. 22, 2015

(30) Foreign Application Priority Data

Dec. 27, 2012 (JP) ..... 2012-286308

(51) Int. Cl.
*F01D 25/12* (2006.01)
*F01D 25/14* (2006.01)
(Continued)

(52) U.S. Cl.
CPC ..... *F01D 25/125* (2013.01); *F01D 25/10* (2013.01); *F01D 25/14* (2013.01); *F02B 39/005* (2013.01);
(Continued)

(58) Field of Classification Search
CPC ..... F10D 25/125; F10D 25/14; F10D 25/10; F02B 39/005; F04D 25/04; F04D 25/0563;
(Continued)

(56) References Cited

U.S. PATENT DOCUMENTS 2,854,296 A * 9/1958 Eberle ..... F01D 25/125 184/6.1
6,415,846 B1 7/2002 O'Hara
(Continued)

FOREIGN PATENT DOCUMENTS

DE 102011003901 A1 * 8/2012 ..... F01D 25/14
DE 102011116658 A1 * 4/2013 ..... F02B 37/025
(Continued)

*Primary Examiner* — Phutthiwat Wongwian
*Assistant Examiner* — Jessica Kebea
(74) *Attorney, Agent, or Firm* — Oblon, McClelland, Maier & Neustadt, L.L.P.

(57) ABSTRACT

A turbocharger includes a turbine housing, a compressor housing, and a bearing housing. Each of the housings includes a passage for cooling inside. The turbocharger further includes a switching valve and a controller that switches a valve position of the switching valve. The switching valve is adapted to switch the circulation state of coolant in each passage such that the coolant is supplied from the passage of the turbine housing to the passage of the bearing housing or such that the coolant is supplied from another passage to the passage of the bearing housing. The controller switches the valve position of the switching valve such that the coolant is supplied from the passage of the turbine housing to the passage of the bearing housing until a predetermined amount of time passes after starting of the engine.

7 Claims, 4 Drawing Sheets

(51) Int. Cl.

| | |
|---|---|
| ***F01D 25/10*** | (2006.01) |
| ***F01D 25/04*** | (2006.01) |
| ***F04D 25/04*** | (2006.01) |
| ***F04D 29/056*** | (2006.01) |
| ***F04D 29/58*** | (2006.01) |
| ***F02B 39/00*** | (2006.01) |

(52) U.S. Cl.
CPC ..... *F04D 25/04* (2013.01); *F04D 29/0563* (2013.01); *F04D 29/582* (2013.01); *F04D 29/584* (2013.01); *F05D 2220/40* (2013.01); *F05D 2260/205* (2013.01)

(58) Field of Classification Search
CPC .. F04D 25/582; F04D 25/584; F05D 2220/40; F05D 2260/205
USPC ..... 60/605.3
See application file for complete search history.

(56) References Cited

U.S. PATENT DOCUMENTS

| | | | | |
|---|---|---|---|---|
| 8,621,865 | B2 * | 1/2014 | Mehring | F01D 25/14 60/605.3 |
| 2016/0076432 | A1 * | 3/2016 | Kindl | F01D 25/14 60/605.1 |

FOREIGN PATENT DOCUMENTS

| | | | | |
|---|---|---|---|---|
| DE | 202013007472 | U1 * | 9/2013 | F01D 25/14 |
| EP | 1384857 | A2 * | 1/2004 | F01D 9/026 |
| JP | 63 61548 | U | 4/1988 | |
| JP | 9 510528 | | 10/1997 | |
| WO | WO 2009106159 | A1 * | 9/2009 | F01D 25/24 |
| WO | WO 2010009945 | A2 * | 1/2010 | F01D 25/14 |

* cited by examiner

TURBOCHARGER

TECHNICAL FIELD

The present invention relates to a turbocharger for an internal combustion engine that includes a turbine housing, a compressor housing, and a bearing housing.

BACKGROUND ART

Patent Document 1 discloses a cooling structure of a turbocharger, in which a compressor housing, a bearing housing, and a turbine housing each include a passage formed inside. Coolant flows through the passage of the compressor housing, the passage of the bearing housing, and the passage of the turbine housing in sequence to cool the entirety of the turbocharger.

PRIOR ART DOCUMENT

Patent Document

Patent Document 1: Unexamined Utility Model Publication No. 63-61548

SUMMARY OF THE INVENTION

Problems that the Invention is to Solve

In the cooling structure disclosed in Patent Document 1, if the coolant further cools the bearing housing, which is already at a low temperature, the temperature of the bearing housing needs more time to increase. This delays the increase in the temperature of lubricant for lubricating a wheel shaft. As a result, the wheel shaft keeps rotating with great friction. This decreases the forced induction efficiency of the turbocharger.

An objective of the present invention is to provide a turbocharger capable of reducing the friction of a rotating wheel shaft even when the temperature of a bearing housing is low.

Means for Solving the Problems

To attain the above objective, a turbocharger includes a turbine housing, a compressor housing, and a bearing housing. Each of the housings includes a passage for cooling inside. The turbocharger further includes a switching valve and a controller that switches the valve position of the switching valve. The switching valve switches a circulation state of coolant in each passage such that the coolant is supplied from the passage of the turbine housing to the passage of the bearing housing or such that the coolant is supplied from another passage to the passage of the bearing housing. The controller is adapted to switch the valve position of the switching valve such that the coolant is supplied from the passage of the turbine housing to the passage of the bearing housing until a predetermined amount of time passes after starting of an engine.

MODES FOR CARRYING OUT THE INVENTION

A turbocharger according to one embodiment will now be described with reference to FIGS. 1 to 5.

Figure 1:
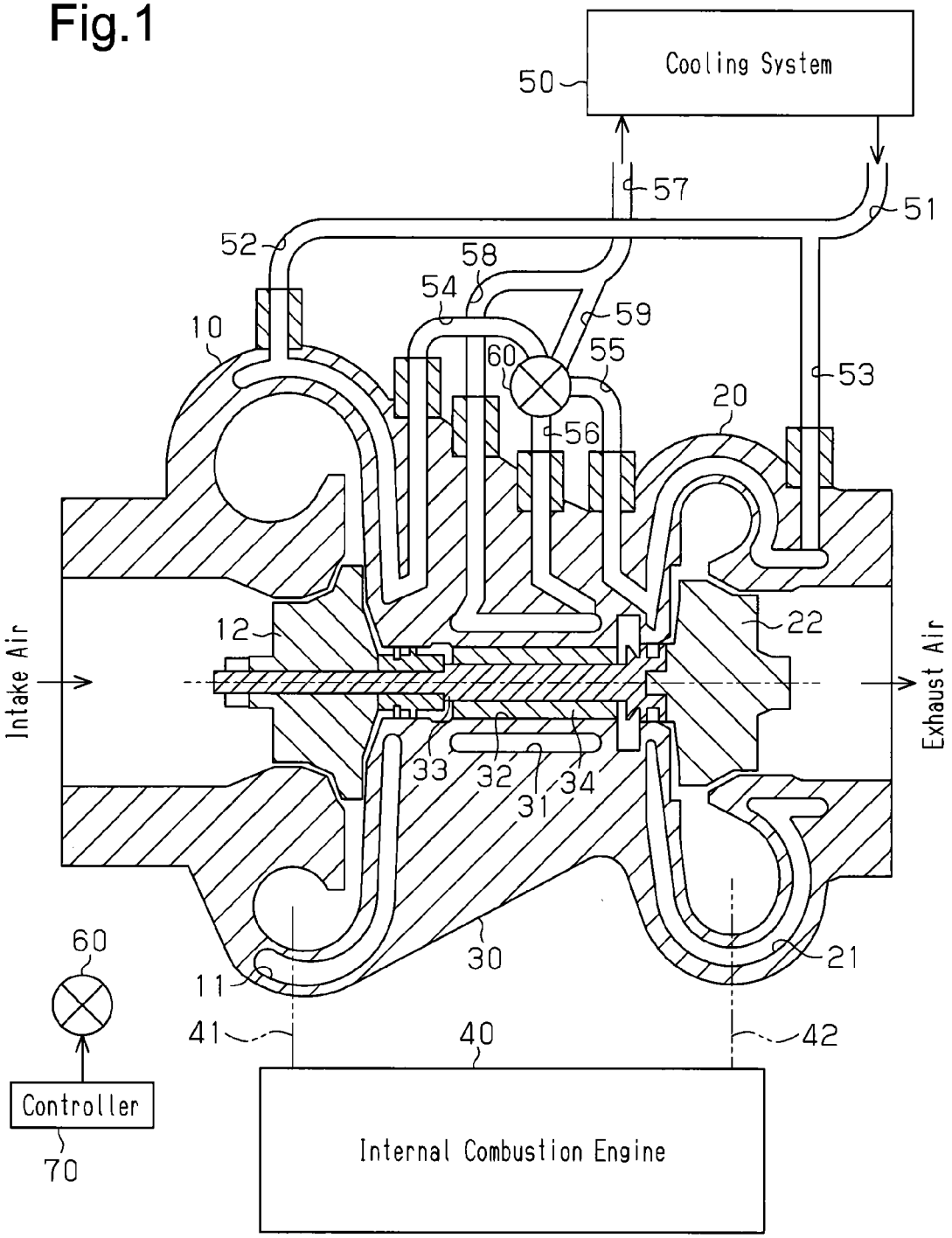
FIG. 1 is a cross-sectional side view of a turbocharger.

As shown in FIG. 1, the turbocharger includes a compressor housing 10, a turbine housing 20, and a bearing housing 30. The compressor housing 10, the turbine housing 20, and the bearing housing 30 are made of an aluminum alloy and formed integrally. The interior of the compressor housing 10 communicates with an intake passage 41 of an internal combustion engine 40. The interior of the turbine housing 20 communicates with an exhaust passage 42 of the combustion engine 40.

The bearing housing 30 includes a hole 32, through which a wheel shaft 33 extends. The wheel shaft 33 is rotationally supported by a bearing 34, which is attached to the inside of the hole 32. The hole 32 is supplied with lubricant for lubrication of the wheel shaft 33 on the bearing 34. The wheel shaft 33 has one end to which a compressor wheel 12 is fixed and another end to which a turbine wheel 22 is fixed.

A compressor passage 11, a turbine passage 21, and a bearing passage 31, through which coolant for cooling the turbocharger passes, are formed in the housings 10, 20, and 30, respectively. The coolant of a cooling system 50 arranged outside the turbocharger circulates through the passages 11, 21, and 31. The valve position of a switching valve 60 switches the circulation state of the coolant.

The cooling system 50 includes a supply passage 51, which is branched off at its downstream side. One of the branches is a compressor supply passage 52, which communicates with the compressor passage 11 to supply the coolant to the compressor passage 11. The other branch is a turbine supply passage 53, which communicates with the turbine passage 21 to supply the coolant to the turbine passage 21. As a result, the coolant of the cooling system 50 is supplied to the compressor passage 11 and the turbine passage 21 through the supply passage 51.

The switching valve 60 is connected to a compressor drainage passage 54, which drains the coolant from the compressor passage 11, and a turbine drainage passage 55, which drains the coolant from the turbine passage 21. In addition to the drainage passages 54 and 55, the switching valve 60 is connected to a bearing supply passage 56, which supplies the coolant to the bearing passage 31. A drainage passage 57 is branched off at its upstream side. One of the branches is a return passage 59, which returns the coolant to the cooling system and is connected to the switching valve 60. The other branch of the drainage passage 57 is connected to a bearing drainage passage 58, which communicates with the bearing passage 31 to drain the coolant from the bearing passage 31. The switching valve 60 switches the circulation state of the coolant in the passages 11, 21, 31, and 51 to 59 between a first circulation state and a second circulation state. For the switching, the valve position of the switching valve 60 is controlled by a controller 70.

Figure 2:
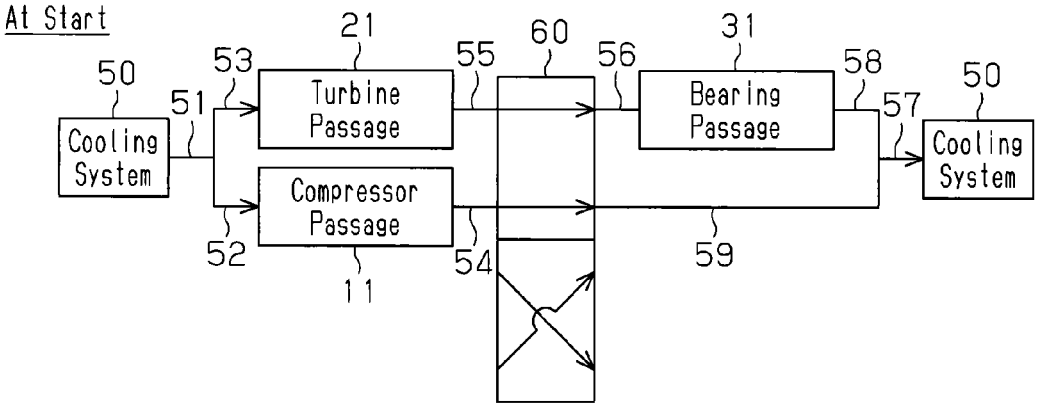
FIG. 2 is a block diagram illustrating the circulation state of coolant at the start.
Figure 3:
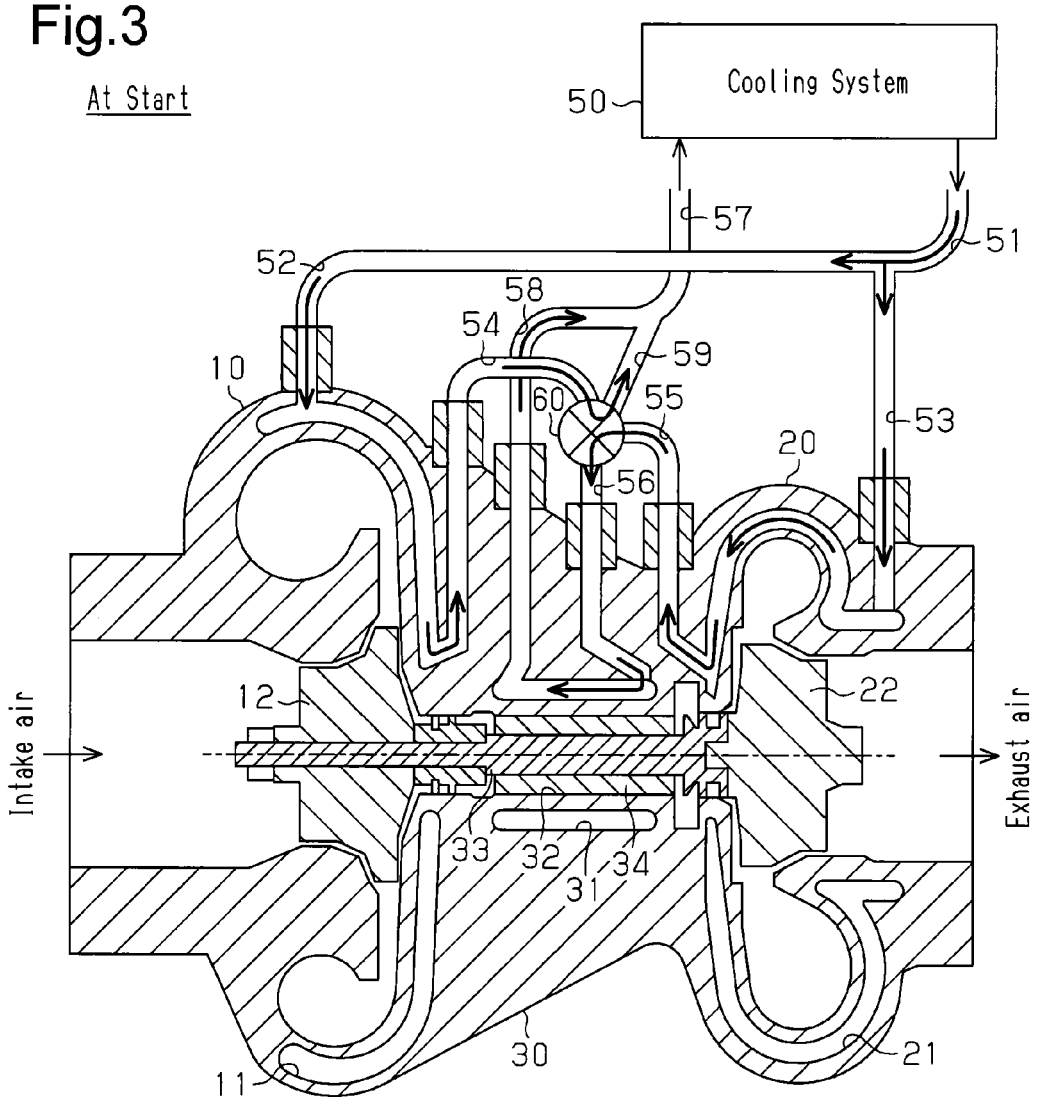
FIG. 3 is a cross-sectional side view of the turbocharger, illustrating the circulation state of the coolant at the start.

As shown in FIGS. 2 and 3, the switching valve 60 in the first circulation state causes the turbine drainage passage 55 and the bearing supply passage 56 to communicate with each other. As a result, the coolant of the cooling system 50 flows through the turbine supply passage 53, the turbine passage 21, the turbine drainage passage 55, the switching valve 60, the bearing supply passage 56, the bearing passage 31, and the bearing drainage passage 58 in sequence, and returns to the cooling system 50. The switching valve 60 in the first circulation state causes the compressor drainage passage 54 and the return passage 59 to communicate with each other. As a result, the coolant of the cooling system 50 flows through the compressor supply passage 52, the compressor passage 11, the compressor drainage passage 54, the switching valve 60, and the return passage 59 in sequence, and returns to the cooling system 50.

Thus, in the first circulation state, the coolant supplied into the turbine housing 20 is drained to the cooling system 50 after being supplied into the bearing housing 30, and the coolant supplied into the compressor housing 10 is directly drained to the cooling system 50.

Figure 4:
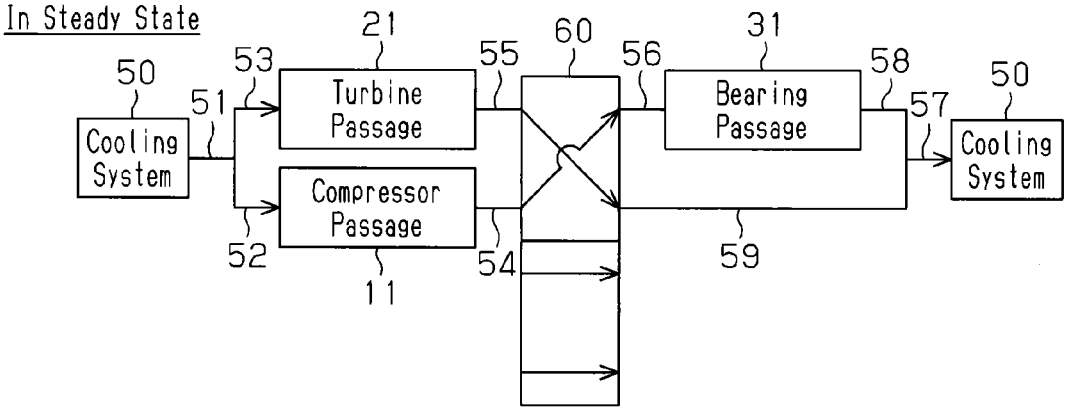
FIG. 4 is a block diagram illustrating the circulation state of the coolant in a steady state.
Figure 5:
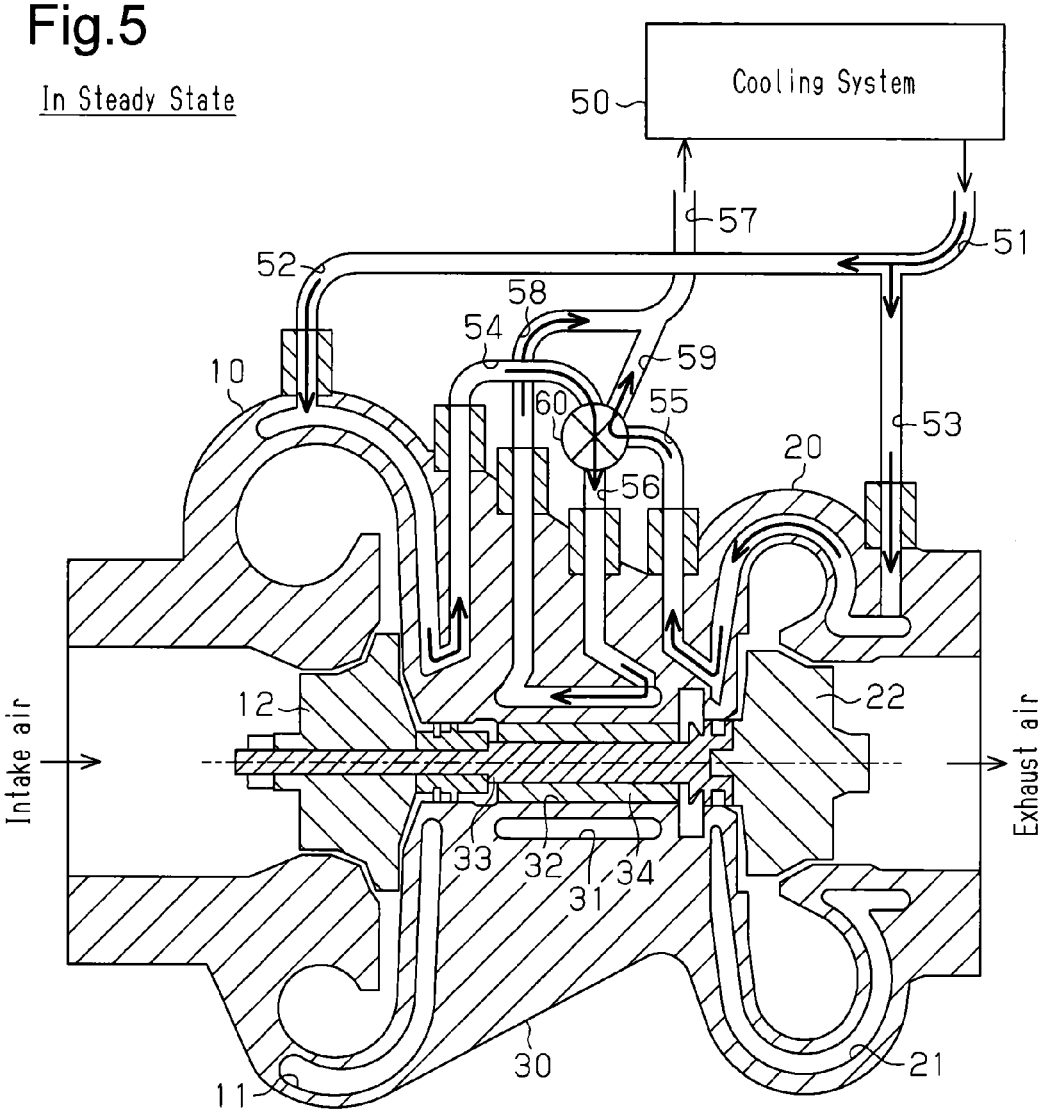
FIG. 5 is a cross-sectional side view of the turbocharger, illustrating the circulation state of the coolant in the steady state.

As shown in FIGS. 4 and 5, the switching valve 60 in the second circulation state causes the compressor drainage passage 54 and the bearing supply passage 56 to communicate with each other. As a result, the coolant of the cooling system 50 flows through the compressor supply passage 52, the compressor passage 11, the compressor drainage passage 54, the switching valve 60, the bearing supply passage 56, the bearing passage 31, and the bearing drainage passage 58 in sequence, and returns to the cooling system 50. The switching valve 60 in the second circulation state also causes the turbine drainage passage 55 and the return passage 59 to communicate with each other. As a result, the coolant of the cooling system 50 flows through the turbine supply passage 53, the turbine passage 21, the turbine drainage passage 55, the switching valve 60, and the return passage 59 in sequence, and returns to the cooling system 50.

Thus, in the second circulation state, the coolant supplied into the compressor housing 10 is drained to the cooling system 50 after being supplied into the bearing housing 30, and the coolant supplied into the turbine housing 20 is directly drained to the cooling system 50.

The circulation state of the coolant is switched to the first circulation state through the control of the switching valve 60 by the controller 70 unless a predetermined amount of time passes after starting the internal combustion engine (hereinafter, referred to as "at the start"). As a result, the coolant is supplied from the turbine passage 21 to the bearing passage 31 at the start.

After the predetermined amount of time has passed from the start of the internal combustion engine 40 (hereinafter, referred to as "in a steady state"), the circulation state of the coolant is switched to the second circulation state through the control of the switching valve 60 by the controller 70. As a result, the coolant is supplied from the compressor passage 11 to the bearing passage 31 in the steady state.

Operation of the turbocharger according to the present embodiment will now be described.

As described above, the coolant is supplied from the turbine passage 21 to the bearing passage 31 at the start. The coolant supplied to the turbine passage 21 flows through the turbine passage 21 to increase the temperature by heat of the turbine housing 20. The temperature of the turbine housing 20 is increased by exhaust heat to be higher than the temperature of the compressor housing 10. As a result, the temperature of the coolant drained from the turbine passage 21 becomes higher than the temperature of the coolant drained from the compressor passage 11. Thus, in comparison with a case in which the coolant is supplied from the compressor passage 11 to the bearing passage 31, the temperatures of the bearing housing 30 and the wheel shaft 33 of the bearing housing 30 promptly increase when the coolant is supplied from the turbine passage 21 to the bearing passage 31. This accelerates the increase in the temperature of the lubricant for lubrication of the wheel shaft 33 even when the bearing housing 30 is at a low temperature at the start.

As shown in FIGS. 4 and 5, the coolant is supplied from the compressor passage 11 to the bearing passage 31 in the steady state. The temperature of the coolant drained from the compressor passage 11 is lower than the temperature of the coolant drained from the turbine passage 21. This limits the increase in the temperatures of the wheel shaft 33 and the lubricant for lubrication of the wheel shaft 33 even when the bearing housing 30 is at a high temperature in the steady state.

The present embodiment as described above achieves the following advantages.

(1) At the start, the bearing passage 31 of the bearing housing 30 is supplied with the coolant at a temperature increased by heat of the turbine housing 20. This promotes the increase in the temperature of the lubricant even when the bearing housing 30 is at a low temperature at the start. Thus, the friction of the rotating wheel shaft 33 is reduced so that the forced induction efficiency of the turbocharger is increased.

(2) In the steady state, the coolant is supplied to the bearing passage 31 from the compressor passage 11 of the compressor housing 10, which is at a lower temperature than that of the turbine housing 20. Thus, the wheel shaft 33 is efficiently cooled in the steady state. This limits the risk of seizure of the wheel shaft 33.

(3) In the turbocharger with the integrated turbine housing 20, compressor housing 10, and bearing housing 30, the heat of the turbine housing 20 is easily transferred to the bearing housing 30. This requires proper regulation of the temperature in the bearing housing 30, especially the wheel shaft 33 and the bearing 34 of the bearing housing 30. In this regard, the coolant is supplied from the turbine passage 21 to the bearing passage 31 at the start, and supplied from the compressor passage 11 to the bearing passage 31 in the steady state. Thus, even in such an integrally formed turbocharger, the coolant flows in a manner according to the temperature of the wheel shaft 33. As a result, these temperatures are properly regulated to maintain a favorable operating condition.

The above illustrated embodiment may be modified in the following forms as necessary.

The circulation state of the coolant may be switched to the first state at times other than the time of starting. For example, the circulation state may be switched to the first state when the lubricant is at a low temperature, when the coolant is at a low temperature, or when a low flow rate of exhaust air has continued for a predetermined amount of time.

Even at the start, the circulation state of the coolant may be switched to the second circulation state. For example, the circulation state of the coolant may be switched to the second circulation state when the temperature of the lubricant is high, when the temperature of the coolant is high, or when the temperature of the bearing housing 30 increases.

Figure 6A:
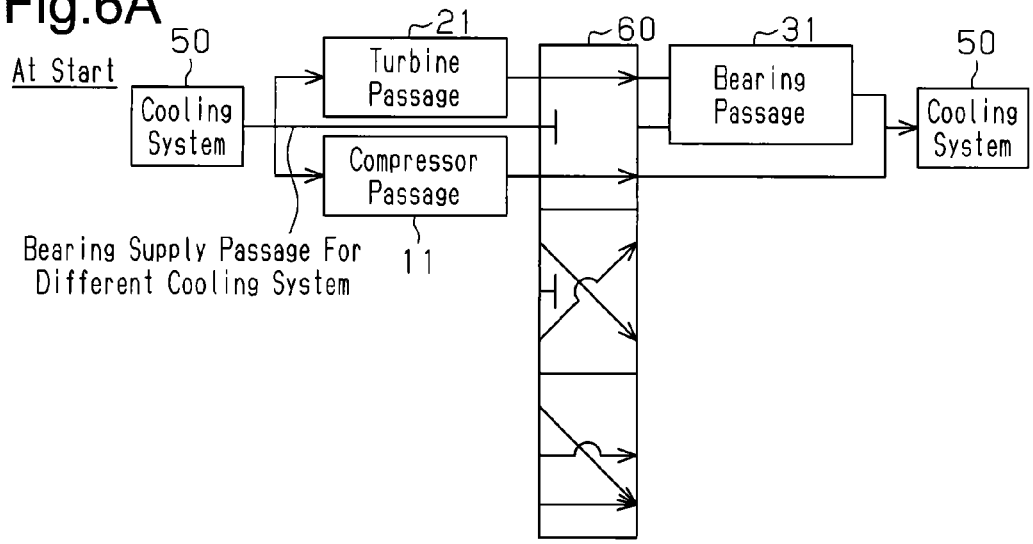
FIGS. 6A to 6C are block diagrams illustrating circulation states of the coolant in a modification.
Figure 6B:
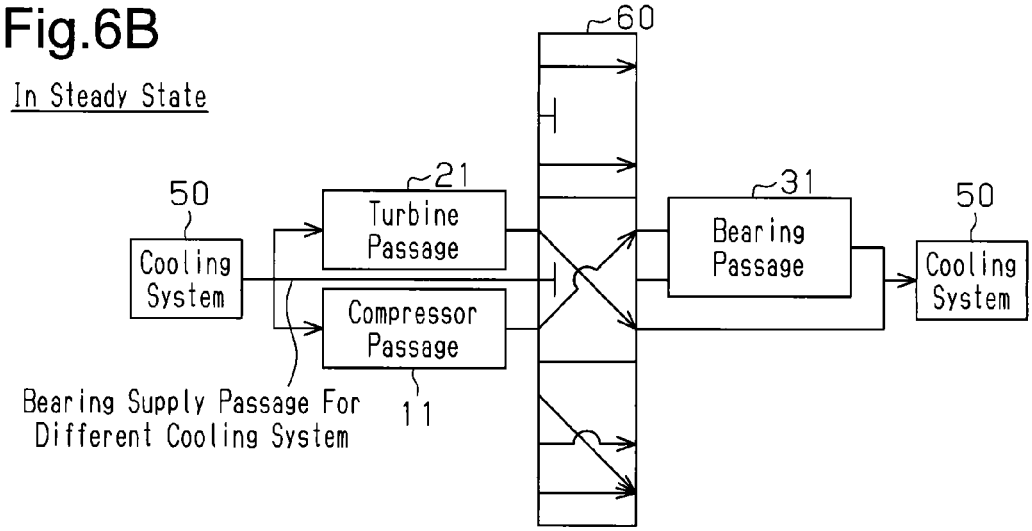
Figure 6C:
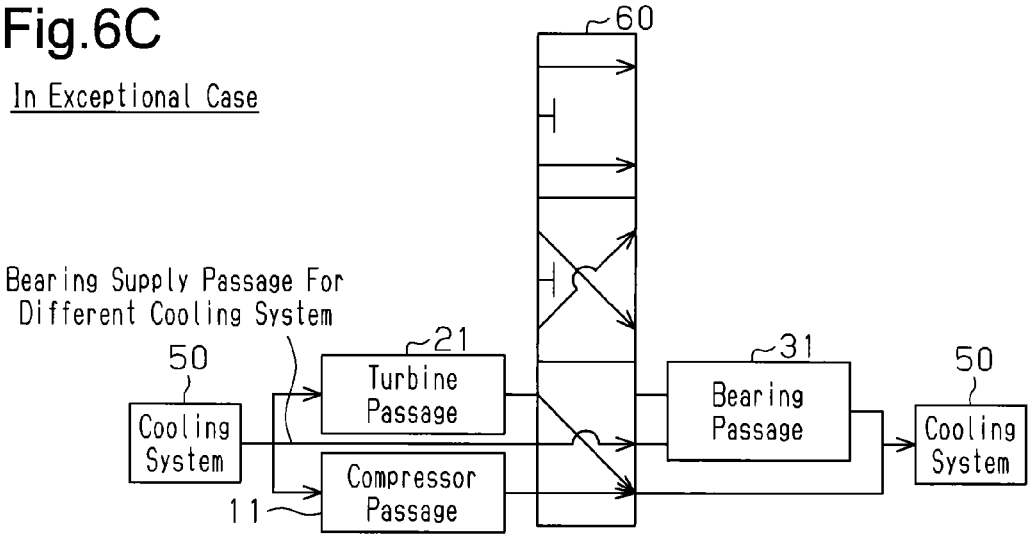

In the steady state, the coolant may be directly supplied to the bearing passage 31 from the cooling system 50. For example, as shown in FIGS. 6A to 6C, the coolant is directly supplied to the bearing passage 31 from the cooling system 50 according to the condition. For this purpose, a bearing supply passage for a different cooling system is further formed such that the coolant is directly supplied to the bearing passage 31 from the cooling system 50. At the start and in the steady state, the circulation state of the coolant is switched through the control of the switching valve 60 by the controller 70 such that the bearing supply passage for the different cooling system does not communicate with the bearing passage 31 as shown in FIGS. 6A and 6B. In an exceptional case in which the bearing housing 30 is in the steady state as shown in FIG. 6C but is at an excessive high temperature, the switching valve 60 is switched such that the compressor passage 11 and the bearing passage 31 do not communicate with the bearing passage 31. The switching valve 60 is also switched such that the bearing supply passage for the different cooling system communicates with the bearing passage 31. Such exceptional cases happen in a circumstance in which a need exists that intensively cool the bearing housing 30 even in the steady state, e.g., when the internal combustion engine 40 continues operating with a heavy load.

The coolant may be directly supplied to the compressor passage 11, the turbine passage 21, and the bearing passage 31 in the steady state as long as the coolant is supplied from the turbine passage 21 to the bearing passage 31 at the start.

The communication structure of the passages 54 to 56, which connect the passages 11, 21, and 31 to one another, may be modified. In accordance with the modification, a plurality of switching valves 60 may be provided on the passages 54 to 56.

The bearing passage 31 may receive the coolant from both the compressor passage 11 and the turbine passage 21. This allows the temperature of the coolant flowing though the bearing passage 31 to be adjusted by adjusting the amount of the coolant supplied to the bearing passage 31 from the compressor passage 11 and the turbine passage 21.

In the first circulation state, the coolant may be supplied to the turbine passage 21, the bearing passage 31, and the compressor passage 11 in sequence. The increase in the temperature of the lubricant at the start is promoted even with this structure in comparison with a case when the coolant is supplied only in the order of the compressor passage 11, the bearing passage 31, and the turbine passage 21.

The housings 10, 20, and 30 of the turbocharger do not necessarily need to be formed integrally. For example, only the compressor housing 10 and the bearing housing 30 may be formed integrally. Alternatively, the housings 10, 20, and 30 of the turbocharger may be assembled after being independently formed.

The circulation state of the coolant is in the first circulation state unless a predetermined amount of time passes after starting the engine, and is switched to the second circulation state after the predetermined amount of time has passed from the start. However, the circulation state of the coolant may be switched based on a parameter related to the temperature of the bearing housing 30, such as a cumulative amount of fuel injection from the start of the engine. Another example of the parameter related to the temperature of the bearing housing 30 is a cumulative amount of intake air from the start of the engine.

The invention claimed is:

1. A turbocharger comprising:

a turbine housing including a turbine cooling passage traveling through the turbine housing, a compressor housing including a compressor cooling passage traveling through the compressor housing, and a bearing housing including a bearing cooling passage traveling through the bearing housing;

a switching valve to supply a coolant to a bearing supply passage of the bearing cooling passage from a turbine drainage passage of the turbine cooling passage or supply the coolant to the bearing supply passage of the bearing cooling passage from a compressor drainage passage of the compressor cooling passage or supply the coolant to the bearing supply passage of the bearing cooling passage from another coolant source; and a controller that switches a valve position of the switching valve, wherein the controller switches the valve position of the switching valve to supply the coolant from the turbine drainage passage to the bearing supply passage of the bearing housing until a predetermined amount of time passes after starting of an engine.

2. The turbocharger according to claim 1, wherein the controller switches the valve position of the switching valve to supply the coolant from the compressor drainage passage of the compressor housing to the bearing supply passage of the bearing housing after the predetermined amount of time has passed from the starting of the engine.

3. The turbocharger according to claim 2, further comprising:

a turbine supply passage that is connected to the turbine cooling passage of the turbine housing and supplies the coolant to the turbine cooling passage of the turbine housing;

the turbine drainage passage that is connected to the turbine cooling passage of the turbine housing and drains the coolant from the turbine cooling passage of the turbine housing;

a compressor supply passage that is connected to the compressor cooling passage of the compressor housing and supplies the coolant to the compressor cooling passage of the compressor housing;

the compressor drainage passage that is connected to the compressor cooling passage of the compressor housing and drains the coolant from the compressor cooling passage of the compressor housing;

the bearing supply passage that is connected to the bearing cooling passage of the bearing housing and supplies the coolant to the bearing cooling passage of the bearing housing;

a bearing drainage passage that is connected to the bearing cooling passage of the bearing housing drains the coolant from the bearing cooling passage of the bearing housing; and a return passage that is connected to the switching valve and directs the coolant from one of the compressor drainage passage and the turbine drainage passage to a turbocharger drainage passage, wherein when the controller switches the valve position of the switching valve to supply the coolant from the turbine drainage passage to the bearing supply passage of the bearing housing until the predetermined amount of time passes after starting of the engine, the bearing supply passage is connected to the switching valve, the turbine drainage passage and the bearing supply passage are caused to communicate with each other, and the compressor drainage passage and the return passage are caused to communicate with each other, and after the predetermined amount of time has passed from the starting of the engine, the turbine drainage passage and the return passage are caused to communicate with each other and the compressor drainage passage and the bearing supply passage are caused to communicate with each other.

4. The turbocharger according to claim 1, wherein, when a temperature of the bearing housing is low, the controller switches the valve position of the switching valve to supply the coolant from the turbine drainage passage of the turbine housing to the bearing supply passage of the bearing housing.

5. The turbocharger according to claim 1, wherein, when a temperature of the bearing housing is high, the controller switches the valve position of the switching valve to supply the coolant from the compressor drainage passage of the compressor housing to the bearing supply passage of the bearing housing.

6. The turbocharger according to claim 1, wherein, when a temperature of the bearing housing is high, the controller switches the valve position of the switching valve to disconnect the compressor drainage passage of the compressor housing and the turbine drainage passage of the turbine housing from the bearing supply passage of the bearing housing and the coolant is directly supplied to the bearing supply passage of the bearing housing from the another coolant source.

7. The turbocharger according to claim 1, wherein the turbine housing, the compressor housing, and the bearing housing are formed integrally.

* * * * *